US008308524B2

(12) United States Patent
deFelice et al.

(10) Patent No.: US 8,308,524 B2
(45) Date of Patent: Nov. 13, 2012

(54) PECTORAL SHOULDER JOINT TOY FIGURE

(75) Inventors: Adam R. deFelice, Los Angeles, CA (US); Terence Higuchi, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 228 days.

(21) Appl. No.: 12/605,114

(22) Filed: Oct. 23, 2009

(65) Prior Publication Data

US 2011/0097969 A1 Apr. 28, 2011

(51) Int. Cl.
*A63H 3/46* (2006.01)

(52) U.S. Cl. ..... 446/375

(58) Field of Classification Search ..... 446/375
See application file for complete search history.

(56) References Cited

U.S. PATENT DOCUMENTS

| | | | |
|---|---|---|---|
| 1,456,422 | A | 5/1923 | Cabana |
| 1,579,367 | A | 4/1926 | Hymer |
| 1,620,069 | A | 3/1927 | Bucherer |
| 1,939,677 | A | 12/1933 | Epstein |
| 2,129,421 | A | 9/1938 | Hales |
| 3,466,793 | A | 9/1969 | Moore |
| 3,731,426 | A | 5/1973 | Lewis et al. |
| 3,874,112 | A | 4/1975 | Sapkus et al. |
| 3,940,880 | A | 3/1976 | Kaelin et al. |
| 3,992,807 | A | 11/1976 | Sapkus et al. |
| 3,995,394 | A | 12/1976 | Ayton |
| 4,274,224 | A | 6/1981 | Pugh et al. |
| 4,279,099 | A | 7/1981 | Dyer et al. |
| 4,310,927 | A | 1/1982 | DeBose |
| 4,571,209 | A | 2/1986 | Manning et al. |
| 4,673,374 | A | 6/1987 | Kelley |
| 4,680,019 | A | 7/1987 | Baerenwald et al. |
| 4,968,282 | A | 11/1990 | Robson et al. |
| 4,988,323 | A | 1/1991 | Price |
| 5,079,778 | A | 1/1992 | Sloot |
| 5,257,873 | A | 11/1993 | Abbat |
| 5,394,766 | A | 3/1995 | Johnson et al. |
| 5,419,729 | A | 5/1995 | Gross |
| 5,516,322 | A | 5/1996 | Myers |
| 5,664,983 | A | 9/1997 | Hollis |
| 6,022,263 | A | 2/2000 | Liu et al. |
| 6,089,950 | A | 7/2000 | Lee et al. |
| 6,110,002 | A | 8/2000 | Langton |
| 6,220,922 | B1 | 4/2001 | Lee et al. |
| 6,267,640 | B1 | 7/2001 | Akashi et al. |

(Continued)

FOREIGN PATENT DOCUMENTS

| | | |
|---|---|---|
| CH | 646612 | 12/1984 |

(Continued)

*Primary Examiner* — Michael Dennis
(74) *Attorney, Agent, or Firm* — Kolisch Hartwell, PC

(57) ABSTRACT

A torso assembly that enables forward and backward shoulder movement for a toy action figure is disclosed. The torso assembly includes a central section and shoulder sections disposed at either side. The central section includes front and back shells. Each shoulder section includes a side shell that partially overlaps the front and back shell portions, and a hinge assembly. Hinge assemblies couple the first and second shoulder sections to each other within the central section, and allow each shoulder section to pivot forward and backward relative to the central section. In some embodiments, the torso assembly may be incorporated into an action figure or doll by movable joints that connect the torso assembly to a lower abdomen and/or pelvis.

19 Claims, 5 Drawing Sheets

U.S. PATENT DOCUMENTS

| | | | | |
|---|---|---|---|---|
| 6,287,166 | B1 | 9/2001 | Lee et al. | |
| 6,296,543 | B1 | 10/2001 | Andrews | |
| 6,328,625 | B1 | 12/2001 | Lee et al. | |
| 6,419,546 | B1 | 7/2002 | Akashi et al. | |
| 6,422,916 | B1 | 7/2002 | Enku | |
| 6,435,938 | B1 | 8/2002 | Lee et al. | |
| 6,439,952 | B1 | 8/2002 | Yamamura | |
| 6,478,653 | B1 | 11/2002 | Langton | |
| 6,482,068 | B2 | 11/2002 | Lee et al. | |
| 6,514,119 | B1 | 2/2003 | Lee et al. | |
| 6,568,984 | B1 | 5/2003 | Applewhite | |
| 6,638,136 | B1 | 10/2003 | Lee et al. | |
| 6,692,332 | B2 | 2/2004 | Jheow | |
| 6,805,606 | B1 | 10/2004 | Kellum | |
| 6,817,921 | B2 | 11/2004 | Chin et al. | |
| 6,830,497 | B1 | 12/2004 | Lee et al. | |
| 6,869,331 | B2 | 3/2005 | Lee et al. | |
| 6,893,318 | B2 | 5/2005 | Soviknes et al. | |
| 7,021,989 | B2 | 4/2006 | Wai | |
| 7,077,717 | B2 * | 7/2006 | Cheng et al. | 446/376 |
| 2003/0027488 | A1 | 2/2003 | Langton | |
| 2003/0119418 | A1 | 6/2003 | Langton | |
| 2003/0162477 | A1 | 8/2003 | Jheow | |
| 2004/0082265 | A1 * | 4/2004 | Langton | 446/373 |
| 2004/0198163 | A1 | 10/2004 | Wai | |
| 2005/0112993 | A1 | 5/2005 | Cheng | |
| 2006/0089079 | A1 | 4/2006 | Enku | |
| 2006/0228985 | A1 | 10/2006 | Wai | |
| 2006/0292965 | A1 | 12/2006 | Strauss | |
| 2007/0149089 | A1 | 6/2007 | De La Torre | |
| 2007/0281582 | A1 | 12/2007 | Himstedt | |
| 2008/0194176 | A1 | 8/2008 | Pennington | |
| 2008/0261484 | A1 | 10/2008 | Culpepper | |

FOREIGN PATENT DOCUMENTS

| | | |
|---|---|---|
| DE | 174835 | 8/1901 |
| EP | 582020 | 2/1994 |
| FR | 1386510 | 5/1965 |
| FR | 2657536 | 8/1991 |
| GB | 2153904 | 8/1985 |
| GB | 2342758 | 4/2000 |
| GB | 2346815 | 8/2000 |
| GB | 2400484 | 10/2004 |
| JP | 62128719 | 6/1987 |
| JP | 04288187 | 10/1992 |
| JP | 06023154 | 2/1994 |
| JP | 06277367 | 10/1994 |
| JP | 2004073514 | 3/2004 |
| JP | 2004305275 | 11/2004 |
| JP | 2005344936 | 12/2005 |
| WO | 2004014507 | 2/2004 |

* cited by examiner

PECTORAL SHOULDER JOINT TOY FIGURE

BACKGROUND

Children enjoy a variety of action figures and dolls that can be manipulated to simulate real life activities, such as martial arts, wrestling, or bodybuilding. Often these action figures allow children to simulate activities the children are not yet able to participate in themselves. Hopefully, these action figures also stimulate imaginations with various play options.

One way of increasing the available play options is to provide action figure toys with numerous movable joints, constructed from durable, strong, moldable plastic. Preferably, these action figures are highly poseable, and stay in position when posed. Examples of bodybuilder poses that might be simulated include a "Front Lat Spread" pose, a "side chest" pose, a "Back Double Biceps" pose, and a "side triceps" pose.

Examples of poseable action figures having movable parts and/or accessories are found in U.S. Pat. Nos. 4,988,323, 6,089,950, 6,267,640, 6,296,543, 6,419,546, 6,422,916, 6,817,921, 6,869,331, and 7,021,989; and in published patent application nos. JP2004073514 and WO2004014507. The complete disclosures of the above patents and patent applications are herein incorporated by reference for all purposes.

SUMMARY

The present disclosure relates generally to a movable action figure. More specifically, it relates to an action figure having torso joints that simulate shoulder and torso movements in the pectoral and scapula regions of a human body. Optionally, it relates to an action figure having torso joints that also simulate twisting or bending movements in the waist region of a human body.

The advantages of the present invention will be understood more readily after a consideration of the drawings and the Detailed Description.

DETAILED DESCRIPTION

Figure 1:
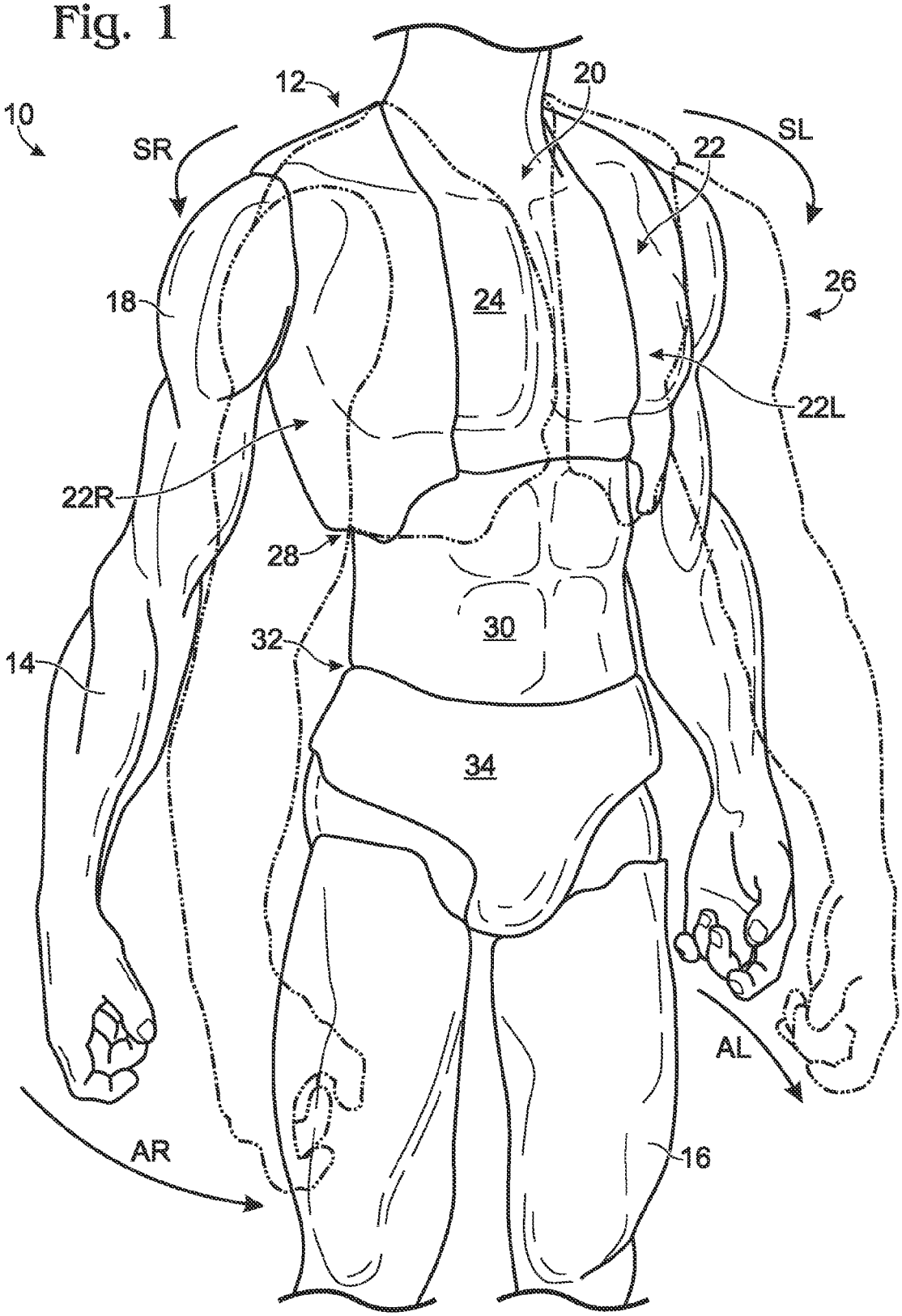
FIG. 1 shows a body of a doll or action figure, viewed from the front and to the right of the body.

Referring to FIG. 1, a toy figure such as an action FIG. 10 or doll 10 is shown, more specifically, a body 10 including a torso assembly 12, arms 14, and legs 16. Body 10 includes a shoulder 18, which has several movable parts and is alternatively called a shoulder joint assembly 18 or a pectoral shoulder joint 18. Arms 14 are each connected to a corresponding shoulder 18 so that arm 14 moves in conjunction with shoulder 18. Arrows SL and SR show an extent of rotation of shoulder joint 18, and arrows AL and AR show movement of arms 14 in conjunction with the corresponding shoulder joint 18.

Torso assembly 12 preferably is segmented into multiple sections, such as a torso central section 20 and a torso shoulder section 22. Shoulder section 22 is sized to be overlapping and at least partially covering central section 20. For reference, an exterior surface 24 of central section is labeled, and a left side shell portion 22L and a right side shell portion 22R are shown substantially covering exterior surface 24. Dashed lines show positions of shoulder section 22 and arm 14 may shift relative to torso central section 20 during articulation of shoulder joint 18.

Central section 20 and shoulder sections 22 may collectively define an upper torso 26, with a midriff 28 defined by the separation of upper torso 26 from a torso lower section 30. Similarly, a waist 32 may be defined by the separation of torso lower section 30 from a pelvis 34.

Figure 2:
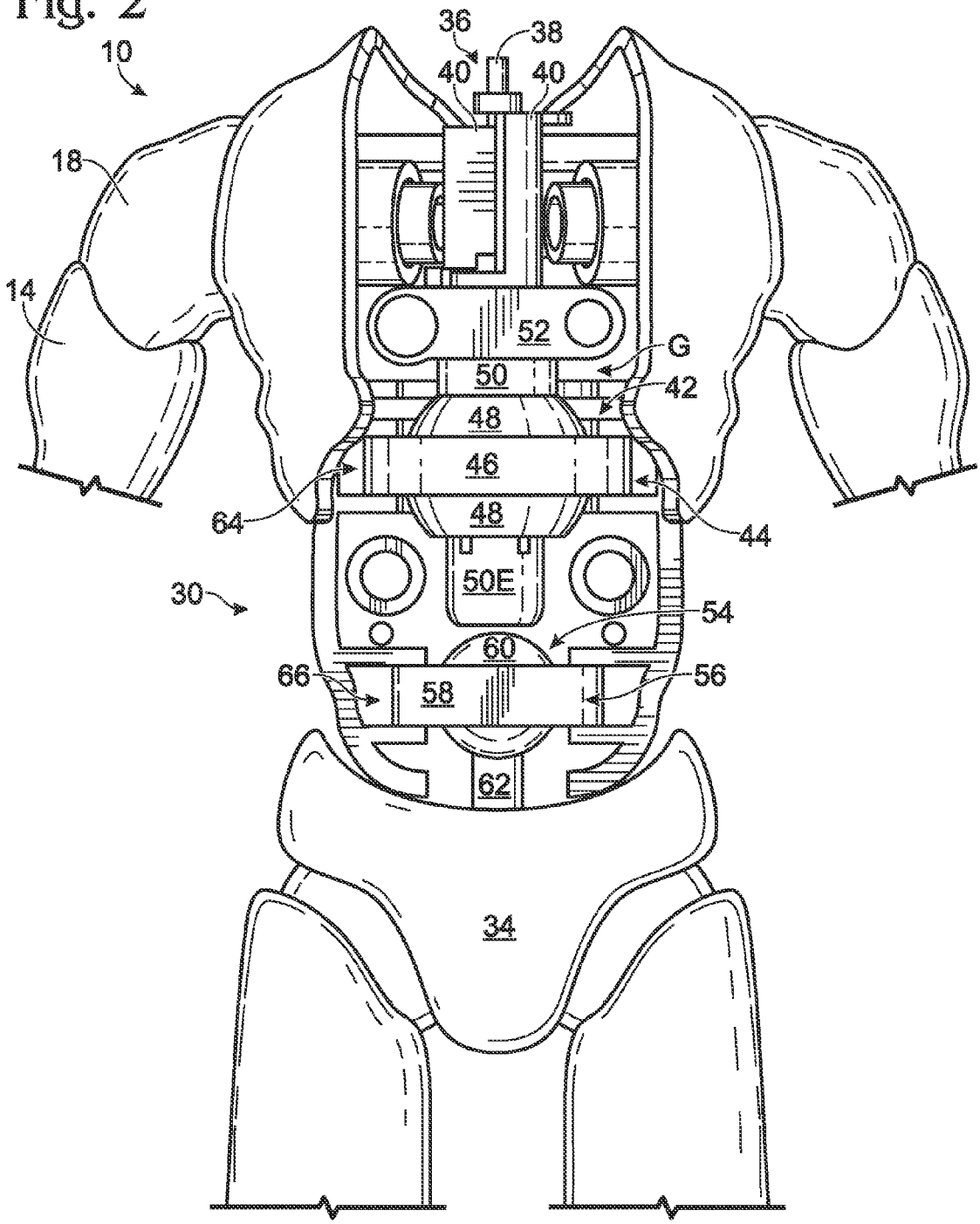
FIG. 2 shows the body of FIG. 1, viewed from the front, with portions removed to show internal elements and joints of the doll or action figure.

Turning now to FIG. 2, internal elements and joints of body 10 are shown, such as a hinge assembly indicated generally at 36. Hinge assembly 36 includes a pin 38, and at least one leaf member 40. Preferably, hinge assembly 36 includes two leaf members 40, and pin 38 defines a single axis for hinge assembly 36. However, in other embodiments, not shown, only a single leaf member 40 might be provided, with only a single arm 14 moving in conjunction with a single shoulder 18. In yet other embodiments, also not shown, a left pin and a right pin may be provided, with a corresponding leaf member 40 for each pin.

An additional, but optional, torso joint is a midriff joint assembly 42, also known as a ball and socket assembly 42. A socket portion 44, preferably in the form of a collar-shaped friction pad 46, captures a ball portion 48 within socket 44, as shown. Midriff joint assembly 42 further includes a shaft 50, which extends from a base assembly 52 for pin 38. In the embodiment shown in FIG. 2, an extended end 50E of shaft 50 helps retain an annular ball-shaped member to form ball 48.

Yet another additional, but optional, torso joint is a waist joint assembly 54, again in the form of a ball and socket assembly. A socket portion 56, preferably in the form of a collar-shaped friction pad 58, captures a ball portion 60 within socket 56. A shaft 62 fixes ball 60 to pelvis 34.

Torso lower section 30 receives the corresponding socket portions of midriff joint assembly 42 and waist joint assembly 54. More specifically, a midriff channel 64 is formed for midriff socket portion 44, and a waist channel 66 is formed for waist socket portion 56.

Figure 3:
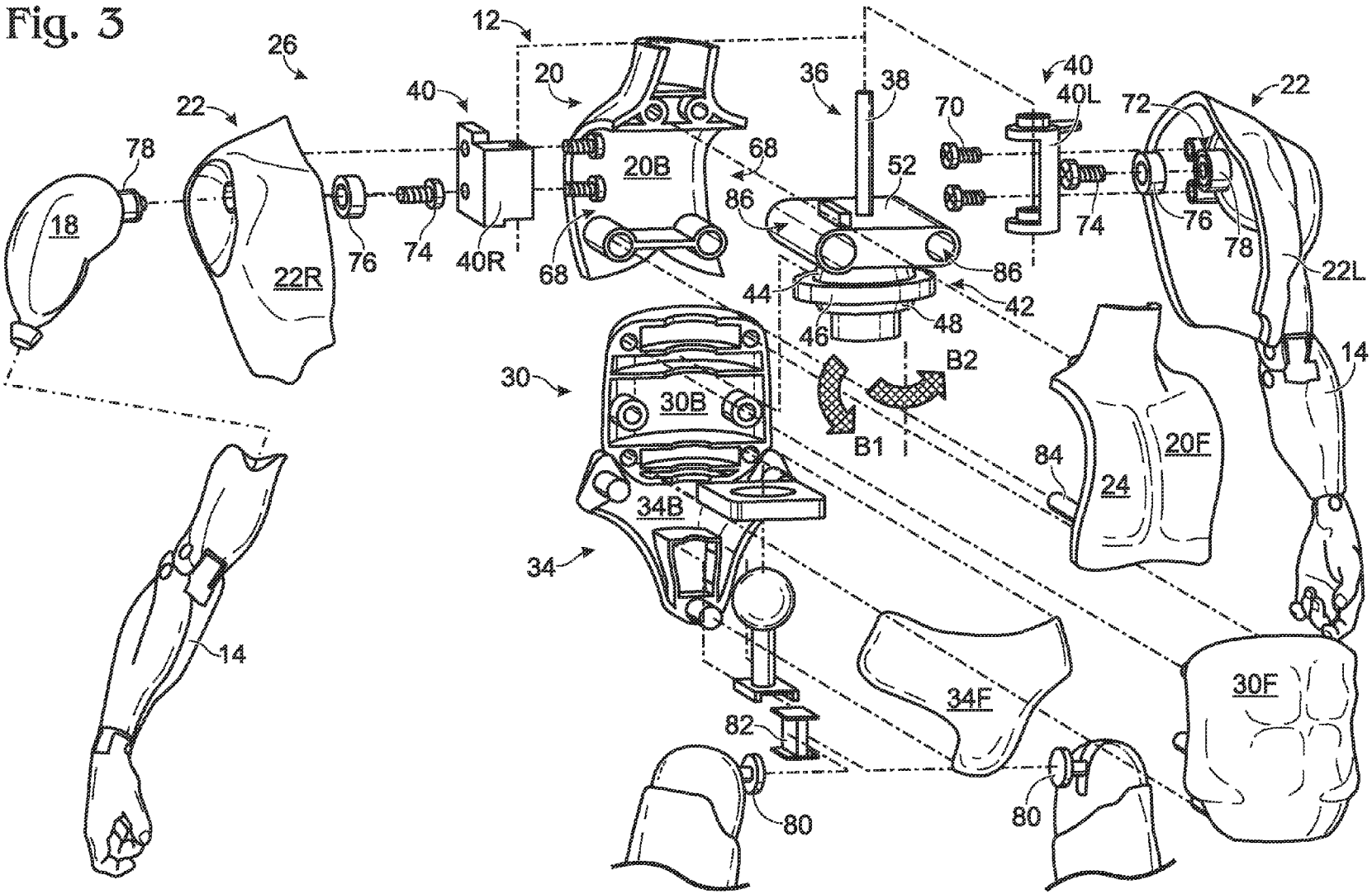
FIG. 3 shows an exploded view of the body of FIG. 2.

FIG. 3 shows an exploded view of the elements discussed above with respect to FIGS. 1 and 2. Central section 20 is shown to include a back shell portion 20B and a front shell portion 20F. Back shell portion 20B and front shell portion 20F define side openings 68 at either side.

Similarly, torso lower section 30 is shown to include a lower back shell portion 30B and a lower front shell portion 30F, and pelvis 34 is shown to include a pelvis back shell portion 34B and a pelvis front shell portion 34F. Corresponding openings are defined for various ones of the joints.

FIG. 3 also shows details inside the upper torso 26, including mounting base 52 that anchors pin 38 and ball 48 to central section 20. Screws 70 are used to anchor one of leaf member 40 to shoulder shell 22, to a corresponding hinge mount 72. Another screw 74 is used to anchor a collar-shaped friction pad 76 to an arm shaft 78, allowing arm 14 to swivel relative to shoulder side portion 22. Referring to the lower edge of FIG. 3, a conventional hip disc 80 is trapped inside pelvis 34, with a friction pad 82 interposed two such discs 80.

Various alternative descriptions are possible of the elements and relationships discussed above, and shown in the drawings. For example, one embodiment includes torso assembly 12, with central section 20 having front and back shell portions 20F and 20B, defining side openings 68 at either side of central section 20. First and second shoulder sections 22 are disposed at either side of central section 20, for simulating forward and backward shoulder movement. Preferably, each shoulder section 22 further includes side shell portion 22L or 22R, configured to cover the corresponding side opening 68 and at least partially overlap the exterior surface 24 of front shell portion 20F, and the exterior surface (not labeled) of back shell portion 20B.

In the embodiment shown in FIG. 3, hinge assembly 36 is disposed within central section 20, and configured to hingedly couple the first and second shoulder sections 22L and 22R to each other and through side openings 68 of central section 20, thereby allowing each shoulder section 22L and 22R to pivot forward and backward relative to the central section, as represented in FIG. 1 by arrows SL and SR, respectively. Preferably, hinge assembly 36 includes pin 38 extending along a longitudinal axis of torso assembly 12, and two leaf members 40L and 40R are freely pivotally coupled to pin 38. Hinge mount 72 secures leaf member 40L to a corresponding one of the shoulder sections, 22L. Base assembly 52 is seated within torso assembly 12, and pin 38 extends from base assembly 52, as shown.

Torso assembly 12 may further include torso lower section 30 pivotally coupled to central section 20 by ball and socket assembly 42 torso lower section 30. Ball and socket assembly 42 may include a socket portion having collar-shaped friction pad 46 and ball portion 48 captured within collar-shaped friction pad 46. Ball portion 48 has at least two rotational degrees of freedom with respect to socket portion 44, as represented in FIG. 3 by arrows B1 and B2.

Referring back to FIG. 2, friction pad 46 is shown to be seated in correspondingly-shaped channel 64, within torso lower section 30. From the construction shown in FIGS. 2 and 3, it will be appreciated that torso lower section 30 and base assembly 52 are sized relative to one another to at least partially limit the extent of rotation of ball portion 48 with respect to socket portion 44. In FIG. 2, a reference dimension, G, indicates the gap between torso lower section 30 and base assembly 52. Base assembly 52 is nonrotatable relative to central section 20, by being trapped within central section 20 by pegs 84 that extend through corresponding sleeves 86, labeled in FIG. 3.

By comparing FIG. 1, showing that shoulder sections 22 pivot backward and forward as represented by arrows SL and SR, to FIG. 3, showing that pin 38 defines a vertical axis, it will be seen that shoulder sections 22 pivot about an axis formed by pin 38. Preferably, both shoulder sections 22L and 22R pivot symmetrically with respect to central section 20.

Central section 20 and shoulder sections 22 collectively form upper torso 26, as shown in FIG. 1, and in some embodiments, torso assembly 12 includes torso lower section 30 coupled to upper torso 26. Upper torso 26 and torso lower section 30 may be pivotally coupled via ball and socket assembly 42, as shown in FIG. 2. Hinge assembly 36 is shown mounted to ball and socket assembly 42.

Yet another embodiment would include torso assembly 12, upper torso 26, central section 20, with front and back shell portions 20F and 20B, and first and second shoulder sections 22L and 22R disposed on opposing sides of central section 20. It would also include torso lower section 30, ball and socket assembly 42 mounted within torso lower section 30, pivotally coupling torso lower section 30 to upper torso 26. Hinge assembly 36 preferably is rigidly coupled to ball and socket assembly 42, and extends generally upward therefrom. Hinge assembly 36 may hingedly couple shoulder sections 22 to central section 20, thereby enabling forward and backward motion of shoulder sections 22 relative to central section 20, as discussed above.

Still another embodiment may include torso central section 20 and outer shoulder 18 pivotally mounted on torso central section 20 so that outer shoulder 18 is overlapping and at least partially covering torso central section 20. Pivoting outer shoulder 18 covers or uncovers portions of torso central section 20, as represented by dashed lines in FIG. 1. Arm 14 may be movably connected to outer shoulder 18, so that arm 14 moves in conjunction with outer shoulder 18 during pivoting of outer shoulder 18, represented by arrows AR and SR, or AL and SL, respectively, in FIG. 1. As shown best in FIG. 3, left shoulder section 22L may be described as part of a first outer shoulder, and right shoulder section 22R may be described as part of a second outer shoulder, both pivotally mounted on torso central section 20. This embodiment would include a second arm movably connected to the second outer shoulder, so that the second arm moves in conjunction with the second outer shoulder during pivoting of the second outer shoulder.

Figure 4:
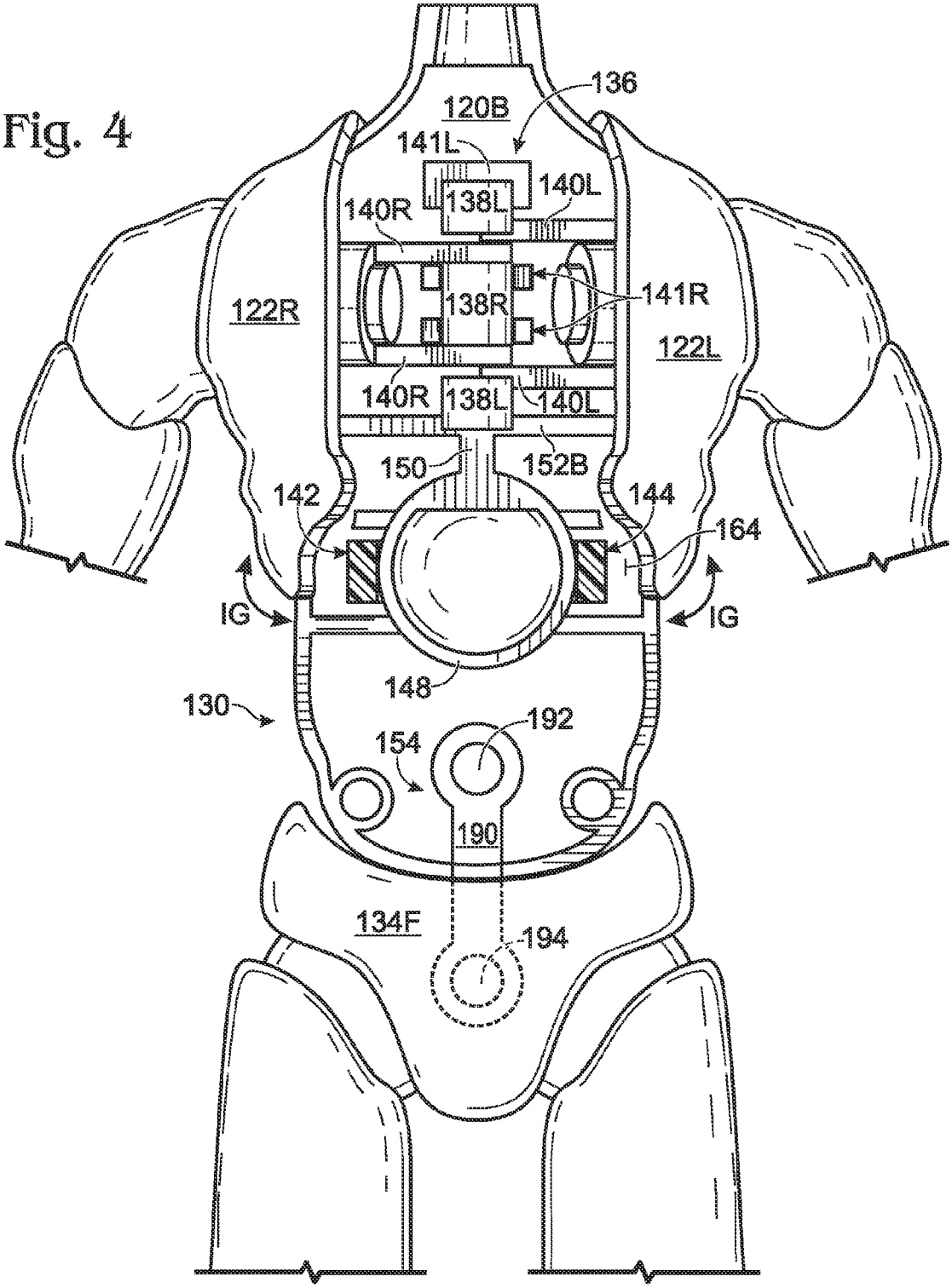
FIG. 4 shows an alternative embodiment of the body of FIG. 1, viewed from the front, with portions removed to show internal elements and joints of the doll or action figure.

FIG. 4 shows an alternative embodiment, in which many of the components are integrally molded from plastic, eliminating various parts. This allows smoother and more extensive pectoral motion. Furthermore, the joints in the elbow and wrist are made with shells having internal pins, concealing these pins for a different ornamental appearance, as is known in the art.

The internal elements and joints of body 10 in FIG. 4 are labeled using similar reference numbers to those discussed above, but beginning with a "1." A hinge assembly is indicated generally at 136, and includes a right pin 138R and right leaf members 140R, integrally molded as part of right side shell portion 122R. Preferably, hinge assembly 136 includes a second set of pins 138L, with a second set of leaf members 140L, integrally molded as part of left side shell portion 122L. Pin 138R and pins 138L may collectively define a single axis. However, in other embodiments, not shown, pin 138R may be slightly off set to the right relative to the axis defined by pins 138L.

The pivoting motion of hinge 136 is formed by pins 138L and 138R seating into corresponding saddles 141R and 141L, integrally molded as part of front shell portion 120F (not shown FIG. 4) and back shell portion 120B, as shown.

An additional, but optional, torso joint is a midriff joint assembly 142, also known as a ball and socket assembly 142. A socket portion 144, preferably in the form of a collar-shaped friction pad 146, captures a ball portion 148 within socket 144, as shown. Midriff joint assembly 142 further includes a shaft 150, which is defined by semi-shafts that extend from corresponding halves of a base assembly 152F (not shown in FIGS. 4) and 152B, all integrally molded as part of front shell portion 120F (not shown in FIG. 4) and back shell portion 120B, in corresponding front and back halves.

Yet another additional, but optional, torso joint is a waist joint assembly 154, in the form of an elastic band 190 extending between an upper post 192 integrally molded as part of a lower front shell portion 130F, and a lower post 194 integrally molded as part of a pelvis front shell portion 134F.

Torso lower section 130 receives the corresponding socket portions of midriff joint assembly 142. More specifically, a midriff channel 164 is formed for midriff socket portion 144.

Figure 5:
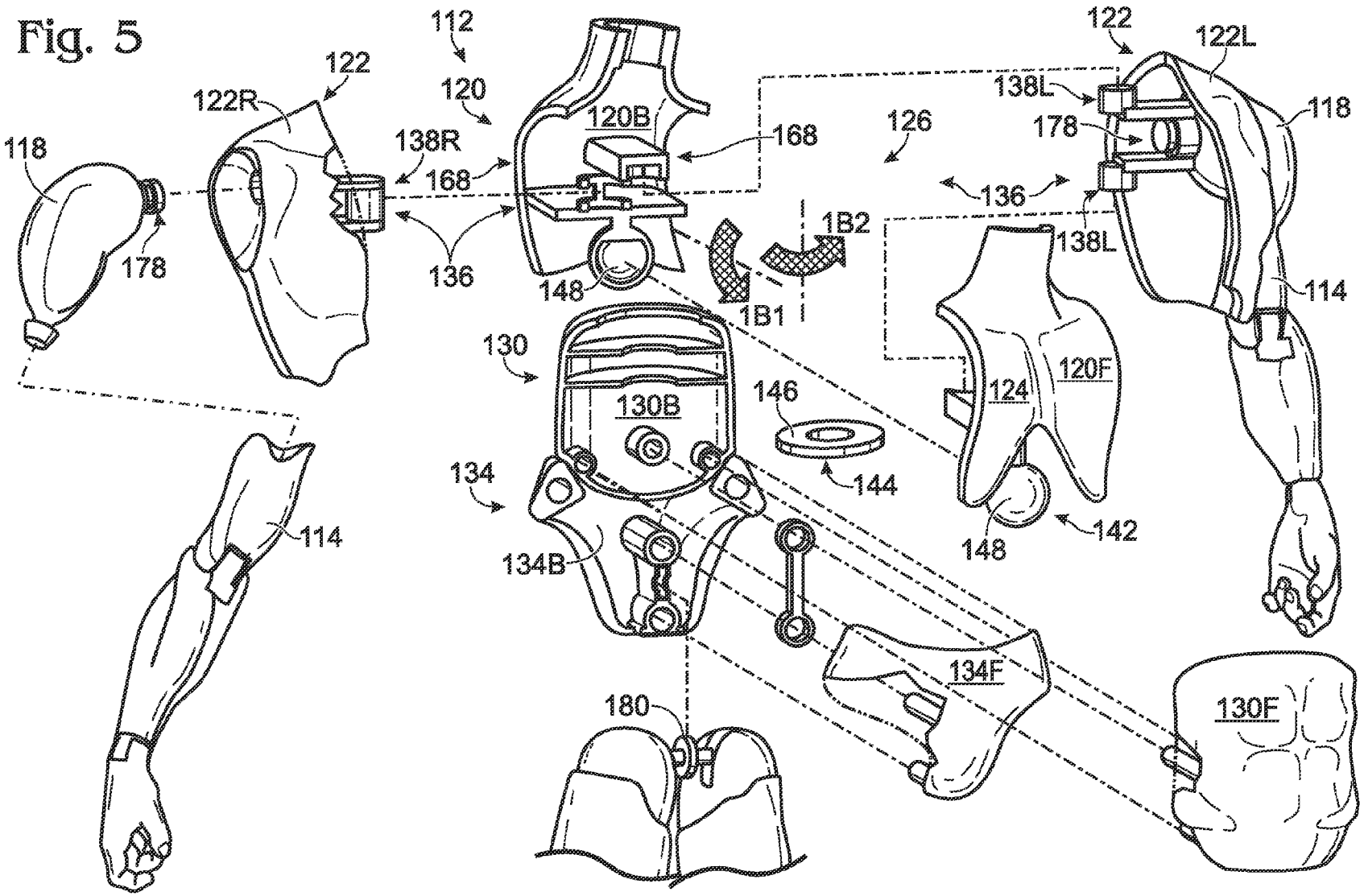
FIG. 5 shows an exploded view of the body of FIG. 4.

FIG. 5 shows an exploded view of the elements discussed above with respect to FIG. 4. Central section 120 is shown to include a back shell portion 120B and a front shell portion 120F. Back shell portion 120B and front shell portion 120F define side openings 168 at either side.

Similarly, torso lower section 130 is shown to include a lower back shell portion 130B and a lower front shell portion 130F, and pelvis 134 is shown to include a pelvis back shell portion 134B and a pelvis front shell portion 134F. Corresponding openings are defined for various ones of the joints.

FIG. 5 also shows details inside the upper torso 126, including an arm disc 178 that is trapped between the two halves of the corresponding shoulder side portion 122L or 122R, allowing arm 114 to swivel relative to upper torso 126. Referring to the lower edge of FIG. 5, a conventional barbell hip connector with a disc 180 is trapped inside pelvis 134.

Various alternative descriptions are possible of the elements and relationships discussed above, and shown in the drawings. For example, one embodiment includes torso assembly 112, with central section 120 having front and back shell portions 120F and 120B, defining side openings 168 at either side of central section 120. First and second shoulder sections 122 are disposed at either side of central section 120, for simulating forward and backward shoulder movement. Preferably, each shoulder section 122 further includes side shell portion 122L or 122R, configured to cover the corresponding side opening 168 and at least partially overlap the exterior surface 124 of front shell portion 120F, and the exterior surface (not labeled) of back shell portion 120B.

In the embodiment shown in FIG. 5, hinge assembly 136 is disposed within central section 120, and configured to hingedly couple the first and second shoulder sections 122L and 122R to each other and through side openings 168 of central section 120, thereby allowing each shoulder section 122L and 122R to pivot forward and backward relative to the central section, as represented in FIG. 1 by arrows SL and SR, respectively.

Torso assembly 112 may further include torso lower section 130 pivotally coupled to central section 120 by ball and socket assembly 142. Ball and socket assembly 142 may include a socket portion having collar-shaped friction pad 146 and ball portion 148 captured within collar-shaped friction pad 146. Ball portion 148 has at least two rotational degrees of freedom with respect to socket portion 144, as represented in FIG. 5 by arrows 1B1 and 1B2.

Referring back to FIG. 4, friction pad 146 is shown to be seated in correspondingly-shaped channel 164, within torso lower section 130. From the construction shown in FIGS. 4 and 5, it will be appreciated that torso lower section 130 and base assembly 152 are sized relative to one another to at least partially limit the extent of rotation of ball portion 148 with respect to socket portion 144. A reference dimension, 1G, indicates the gap between torso lower section 130 and the first shoulder sections 122L and 122R.

By comparing FIG. 1, showing that shoulder sections 22 pivot backward and forward as represented by arrows SL and SR, to FIG. 5, showing that pin 138R defines a vertical axis, and pins 138L define a separate vertical axis, it will be seen that shoulder sections 122L and 122R pivot symmetrically with respect to central section 120.

Central section 120 and shoulder sections 122 collectively form upper torso 126, and in some embodiments, torso assembly 112 includes torso lower section 130 coupled to upper torso 126. Upper torso 126 and torso lower section 130 may be pivotally coupled via ball and socket assembly 142, as shown in FIG. 4.

Yet another embodiment would include torso assembly 112, upper torso 126, central section 120, with front and back shell portions 120F and 120B, and first and second shoulder sections 122L and 122R disposed on opposing sides of central section 120. It would also include torso lower section 130, ball and socket assembly 142 mounted within torso lower section 130, pivotally coupling torso lower section 130 to upper torso 126. Hinge assembly 136 preferably is rigidly coupled to ball and socket assembly 142, and extends generally upward therefrom. Hinge assembly 136 may hingedly couple shoulder sections 122 to central section 120, thereby enabling forward and backward motion of shoulder sections 122 relative to central section 120, as discussed above.

Still another embodiment may include torso central section 120 and outer shoulder 118 pivotally mounted on torso central section 120 so that outer shoulder 118 is overlapping and at least partially covering torso central section 120. Pivoting outer shoulder 118 covers or uncovers portions of torso central section 120. Arm 114 may be movably connected to outer shoulder 118, so that arm 114 moves in conjunction with outer shoulder 118 during pivoting of outer shoulder 118. As shown best in FIG. 5, left shoulder section 122L may be described as part of a first outer shoulder, and right shoulder section 122R may be described as part of a second outer shoulder, both pivotally mounted on torso central section 120. This embodiment would include a second arm movably connected to the second outer shoulder, so that the second arm moves in conjunction with the second outer shoulder during pivoting of the second outer shoulder.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A torso assembly for simulating forward and backward shoulder movement as part of a toy figure, the torso assembly comprising: a central section having front and back shell portions defining side openings at either side of the central section; first and second shoulder sections disposed at either side of the central section, each shoulder section further including: a side shell portion configured to cover the corresponding side opening and at least partially overlap the exterior surfaces of the front and back shell portions, and a hinge assembly disposed within the central section directly coupling the first and second shoulder sections to each other and through the side openings of the central section, thereby allowing each shoulder section to pivot forward and backward relative to the central section.

2. The torso assembly of claim 1, wherein the hinge assembly includes a pin extending along a longitudinal axis of the torso assembly, and two leaf members freely pivotally coupled to the pin; and a hinge mount securing one of the leaf members to a corresponding one of the shoulder sections.

3. The torso assembly of claim 2, further including a base assembly seated within the torso assembly, wherein the pin extends from the base assembly.

4. The torso assembly of claim 3, further comprising a torso lower section and a ball and socket assembly pivotally coupling the torso lower section to the central section.

5. The torso assembly of claim 4, wherein the ball and socket assembly includes a socket portion having a collar-shaped friction pad and a ball portion captured within the collar-shaped friction pad;

wherein the ball portion has at least two rotational degrees of freedom with respect to the socket portion; and wherein the friction pad is seated in a correspondingly-shaped channel within the torso lower section.

6. The torso assembly of claim 4, wherein the torso lower section and the base assembly are sized relative to one another to at least partially limit the extent of rotation of the ball portion with respect to the socket portion.

7. The torso assembly of claim 3, wherein the base assembly is nonrotatable relative to the central section.

8. The torso assembly of claim 2 wherein the shoulder sections pivot backward and forward about the axis formed by the pin.

9. The torso assembly of claim 1, wherein both shoulder sections pivot symmetrically with respect to the central section.

10. The torso assembly of claim 1, wherein the central section and shoulder sections collectively form an upper torso, and wherein the torso assembly further comprises a torso lower section coupled to the upper torso.

11. The torso assembly of claim 10, wherein the upper torso and torso lower section are pivotally coupled via a ball and socket assembly.

12. The torso assembly of claim 11, wherein the hinge assembly is mounted to the ball and socket assembly.

13. The torso assembly of claim 10, wherein the shoulder sections at least partially overlap the torso lower section.

14. A torso assembly for a toy figure, comprising: an upper torso including: a central section with front and back shell portions; and first and second shoulder sections disposed on opposing sides of the central section; a torso lower section; a ball and socket assembly mounted within the torso lower section and pivotally coupling the torso lower section to the upper torso; and a hinge assembly rigidly coupled to the ball and socket assembly and extending generally upward therefrom, the hinge assembly directly coupling the shoulder sections to the central section and enabling forward and backward motion of the shoulder sections relative to the central section.

15. The torso assembly of claim 14, wherein:

the hinge assembly includes a pin extending along a longitudinal axis of the torso assembly, and two leaf members freely pivotally coupled to the pin; and each shoulder section is secured to one of the leaf members.

16. The torso assembly of claim 15, wherein the shoulder sections pivot backward and forward about the axis formed by the pin.

17. The torso assembly of claim 14, wherein both shoulder sections pivot symmetrically with respect to the central section.

18. The torso assembly of claim 14, wherein the shoulder sections at least partially overlap the torso lower section.

19. The torso assembly of claim 14, wherein:

the ball and socket assembly includes a socket portion having a collar-shaped friction pad and a ball portion captured within the collar-shaped friction pad;

wherein the ball portion has at least two rotational degrees of freedom with respect to the socket portion; and wherein the friction pad is seated in a correspondingly-shaped channel within the torso lower section.

* * * * *